United States Patent [19]

Moore

[11] Patent Number: 4,926,089

[45] Date of Patent: May 15, 1990

[54] TIED SLIT FOIL SHADOW MASK WITH FALSE TIES

[75] Inventor: Melvin L. Moore, Woodlawn, Ill.

[73] Assignee: Zenith Electronics Corporation, Glenview, Ill.

[21] Appl. No.: 279,188

[22] Filed: Dec. 2, 1988

[51] Int. Cl.[5] ..... H01J 29/07

[52] U.S. Cl. ..... 313/403; 313/269

[58] Field of Search ..... 313/403, 402, 269

[56] References Cited

U.S. PATENT DOCUMENTS

| | | | |
|---|---|---|---|
| 2,813,213 | 11/1957 | Cramer . | |
| 2,905,845 | 9/1959 | Vincent . | |
| 3,638,063 | 1/1972 | Tachikawa . | |
| 3,894,321 | 7/1975 | Moore | 313/402 X |
| 3,944,867 | 3/1976 | Kaplan | 313/403 |
| 3,989,524 | 11/1976 | Palac . | |
| 4,100,451 | 7/1978 | Palac . | |
| 4,495,437 | 1/1985 | Kume | 313/403 |
| 4,686,416 | 8/1987 | Dougherty . | |
| 4,695,761 | 9/1987 | Fendley . | |

FOREIGN PATENT DOCUMENTS 2052148 6/1980 United Kingdom .

OTHER PUBLICATIONS

"Improvements in the RCA Three-Beam Shadow--Mask Color Kinescope," Grimes, 1954, *Proceedings of the I-R-E*, pp. 315-326.

*Primary Examiner*—Palmer C. DeMeo

[57] ABSTRACT

A front assembly for a color cathode ray tube is disclosed that includes a glass faceplate that has one its inner surface a centrally disposed phosphor screen. A metal foil shadow mask is mounted in tension on a mask-support structure located on opposed sides of the screen. The mask comprises a series of parallel strips separated by slits, the strips being coupled by widely spaced ties. The mask according to the invention has between the strips one or more false ties extending partially between but not interconnecting adjacent strips. The screen may also have spaced ties interconnecting the grille lines with a periodicity much smaller than that of the mask ties and below an observer's resolution threshold at normal viewing distances. An associated manufacturing process is also described.

12 Claims, 7 Drawing Sheets

TIED SLIT FOIL SHADOW MASK WITH FALSE TIES

CROSS-REFERENCE TO RELATED APPLICATIONS

This application is related to but in no way dependent upon copending applications Ser. No. 058,095 filed Jun. 4, 1987, now U.S. Pat. No. 4,828,523; Ser. No. 223,475 filed Jul. 22, 1988, now U.S. Pat. No. 4,902,257; and Ser. No. 338,531 filed Dec. 2, 1988, all of common ownership herewith.

SPECIFICATION

This specification includes an account of the background of the invention, a description of the best mode presently contemplated for carrying out the invention, and appended claims.

BACKGROUND OF THE INVENTION

1. Field of the Invention

This invention relates to color cathode ray picture tubes, and is addressed specifically to a means and process providing for a color cathode ray tube having a tensed foil slit mask.

Color cathode ray tubes for television and computer displays universally employ an apertured shadow mask for ensuring that electrons from each of the three electron guns strike only areas capable of emitting light of the appropriate color. Two types of shadow masks are in common use: dot masks, with substantially circular apertures, are primarily used in computer display applications; slot masks, with parallel elongated apertures, are generally preferred in television receivers. Several well-known factors make the slot mask somewhat more economical in the television environment.

Two different forms of the slot mask can be found in conventional color tubes. In the most widely used form depicted in FIG. 1*a*, the slots are bridged by tie bars at frequent intervals, as indicated. Typically, the spacing between two tie bars in a given slot is of the same order as the center-to-center spacing between the two metal strips which form the slot. Due to the high density of tie bars, such a mask has very substantial mechanical strength in the transverse direction, i.e. at right angles to the major axis of the slots. Such strength is essential because the mask, after passing through the photoetching processs which generates the slot-and-tie bar pattern, is formed into a dome shape in order to match the curved faceplate. During the forming process, the mask is stressed beyond its elastic limit, and it is essential that the tie bars do not break.

A second well known form of the slot mask (sometimes called a "slit" mask) uses no tie bars. The etched mask, essentially a parallel array of narrow strips held together only at the ends, is stretched over a strong, specially shaped frame so that the tensioned strips form a sector of a cylindrical surface (see FIG. 1*b*). The tension ensures that all strips remain straight. This design has the disadvantage that each strip is capable of vibrating independently, with very little damping. Conventionally, this deficiency is remedied by stretching one or several small diameter wires or fibers around the cylindrical surface, lightly touching all strips. (See U.S. Pat. No. 3,683,063.)

Both forms of the mask are generally made of sheet steel or similar material 0.005 to 0.010 inches thick, with the greater thicknesses used in larger tubes.

Recently, color cathode ray tubes were introduced in which the faceplate is not curved at all but is ground flat. The shadow mask in these tubes, referred to as tension mask tubes, is made of steel foil only 0.001 inch thick and held under high mechanical tension, amounting to a substantial fraction (typically more than 50%) of the elastic limit of the mask material. Dot masks (masks with circular holes) of this type, primarily intended for computer displays, may be put under uniform tension about their entire circumference. They are then welded, e.g. by laser welding, to four rail-like support structures surrounding the display area.

The tension mask tube offers a number of advantages over the conventional color tube with a curved faceplate and correspondingly curved mask. One important advantage lies in the fact that the photoetched mask is never stressed beyond its elastic limit. Therefore, masks made from the same master are alike and remain alike to a high degree of accuracy. Because the faceplate is also flat, the screen, i.e., the grille (black matrix) and the phosphor pattern can be deposited on the faceplate by a variety of printing processes such as offset printing or screen printing, thereby circumventing the cumbersome and costly photolithographic processes used in the manufacture of conventional color tubes. Screens made this way from a common master are also alike to a high degree of accuracy. Any mask may, therefore, be mated to any screen, for example by the process described in referent copending application Ser. No. 223,475, assigned to the assignee of this invention. For use in a television receiver, it may be desired to substitute a slot mask for the dot mask in a tension mask tube. The question then arises as to what the structure of the slot mask should be to achieve the desired performance at minimum cost. For example, it is possible to substitute a foil mask etched with the slot-and-tie bar pattern shown in FIG. 1*a* for the dot mask in the manufacturing process just described. Of course, the etched mask need not be formed into a dome shape but is allowed to remain flat. However, when the mask is stretched, care must be taken to apply just the right amount of force in the transverse direction, generally much less than the force applied parallel to the strips. Preferably this is done by observing the transverse displacements and feeding the information so obtained back to the force generating means, as taught in the above-mentioned '475 application. To lock the stretched mask in place, four support structures surrounding the display area are required just as in the case of the dot mask.

A "slot mask," as the term is used herein, has a dome shape. In its intended use and function, it is very similar to a "dot mask" but with elongated holes, the mask having enough structural strength in all directions to be metal-formed to a self-sustaining, three-dimensional curvature. A "slit mask," as the term is used herein, comprises parallel strips which have no interconnection.

Since in the manufacturing process of a tension mask tube the mask remains flat, it would appear that the tie bars shown in FIG. 1*a* are not needed. A foil mask may be etched in accordance with the pattern shown in FIG. 1*b* and stretched over just two support structures so as to put all strips under the desired tension. However, the fact that the foil is so thin makes it difficult to handle; it must be kept in mind that the bending stiffness of a strip is proportional to the cube of its thickness, so that a strip 0.001 inch thick is 125 times as flexible as a strip 0.005 inch in thickness. Therefore, if a foil mask patterned like the mask shown in FIG. 1*b* is to be used in production, it becomes necessary to resort to special handling techniques which increase the cost. In addition, the method of vibration damping based on stretching wires or fibers across the tensed mask is not as effective on a flat surface as it is on a cylindrical surface.

Thus it is evident that niether of the two known forms of the slot mask structure is fully satisfactory for use in a tension mask tube. The version derived from FIG. 1*a* requires four support structures in each tube, and to ensure interchangeability, an elaborate servo system is needed to control transverse displacement. The version derived from FIG. 1*b* requires only two support structures in each tube, but cost is increased by the need for special techniques to handle the mask, and there is a potential problem with insufficient vibration damping.

3. Other Prior Art

| U.S. Pat. Nos. | |
|---|---|
| 2,813,213 to Cramer et al | 3,994,867 to Kaplan |
| 2,842,696 to Fischer-Colbrie | 4,100,451 to Palac |
| 2,905,845 to Vincent | 4,686,416 to Strauss |
| 3,638,063 to Tachikawa | 4,495,437 to Kume et al |
| 3,894,321 to Moore | 4,695,761 to Fendley |
| 3,989,524 to Palac | |
| British Patent - GB 2 052 148 A to Sony | |

A journal article

"Improvements in the RCA Three-Beam Shadow Mask Color Kinescope," by Grimes et al. The IRE, Jan. 1954. Dec. Class. R583.6.1.

OBJECTS OF THE INVENTION

It is an object of this invention is to provide an improved slit mask and associated front assembly for use in a foil tension mask color cathode ray tube.

It is a particular object of the invention to provide a slit mask with a strip tie arrangement in which, at minimum normal viewing distance, the ties are not visible to the viewer.

It is a further object of the invention to provide a shadow mask having false ties to enhance uniformity in the appearance of the screen.

It is yet another object of the invention to provide false ties in the grille to mask visibility of mask tie shadows on the screen.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DESCRIPTION OF THE PREFERRED EMBODIMENT

A slit-type foil tension mask according to the invention for use in a color cathode ray tube comprises a series of parallel strips separated by slits, the strips being loosely coupled by widely spaced ties. The wide tie spacing produces a strip coupling which promotes handleability of the mask during mask and tube fabrication and facilitates damping of strip vibration when mounted in a tube, but which is insufficient to induce unacceptable Poisson contraction of the mask when uniaxially tensed along the direction of the strips in the plane of the mask, or to permit an unacceptable thermal expansion perpendicular to and in the plane of said strips. The mask has between the ties one or more false ties extending partially between but not interconnecting adjacent strips.

Figure 2A:
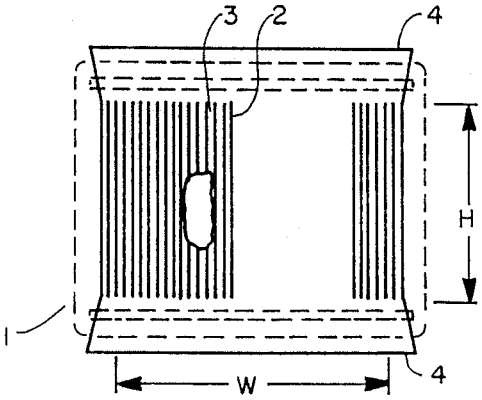
FIG. 2*a* is a plan view of a slit mask assembly showing schematically a tied slit mask according to the invention described and claimed in referent copending application Ser. No. (5975) for use in a tension mask tube.
Figure 2B:
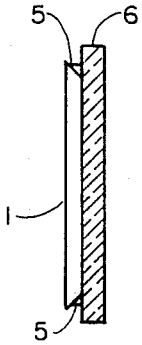
FIG. 2*b* is a side view of the mask assembly shown by FIG. 2*a*.

FIG. 2*a* indicates schematically a tied slit mask 1 made in accordance with this invention for use in a tension mask color cathode ray tube. It is composed of steel foil about 0.001 inch thick. The width W of the usable picture area is somewhat smaller than the actual width of the mask. The height of the usable area is designated H. Within the usable area, the mask comprises many parallel strips 2 separated by parallel slits 3. All strips 2 terminate at the top and bottom in end members 4. In the assembled tube, end members 4 are welded to support structures 5 (FIG. 2*b*) which hold them under uniform tension T (e.g., 40 lb. per inch of width). FIG. 2*b* is a side view of the completed faceplate-mask assembly. Support structures 5, also referred to as "rails," are attached to a faceplate 6 and support the mask 1 under tension.

Figure 2C:
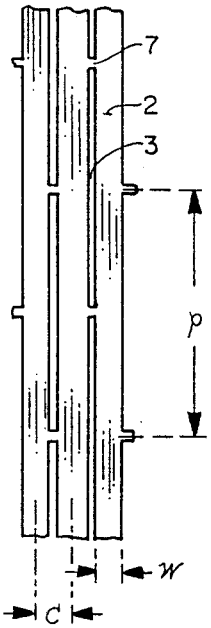
FIG. 2*c* depicts a portion of the mask, greatly enlarged, taken from the inset indicated in FIG. 2*a;*

A small portion of the mask is shown magnified in FIG. 2*c*. The straight strips 2 are shown as being interconnected by ties 7 which are arranged so the slits 3 form a brickwall-like pattern. The tie pitch, i.e., the center-to-center spacing of adjacent ties within one slit, is designated p. The center-to-center spacing between neighboring strips is c. The width of a single strip is designated w.

To understand the problem solved by this invention, assume that each of the end members 4 is solidly clamped so that its width cannot change, and that force is then applied to the clamps to produce throughout mask 1 a tension T (force per unit width), equivalent to a force Tc per strip.

The natural tendency of a long, narrow strip when subjected to a tensioning force is to become straight. In mask 1, however, this tendency is opposed by the elastic cross contraction, or "Poisson's contraction," of each strip. As the applied tension T causes each strip to become longer, it also becomes a little narrower. For example, a mask made of 0.001" thick steel foil having a height H=16" and a usable width W=22" (i.e., a 27" diagonal) may have a center-to-center strip spacing c=0.03", with strips of widths w=0.024" separated by 0.006" wide slits which are bridged by the ties.

Figure 1A:
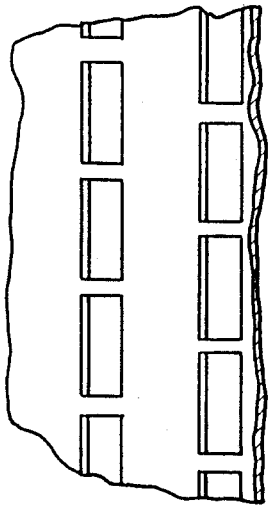
FIG. 1a (PRIOR ART)
FIG. 1*a* is greatly enlarged view in perspective of a small section of a form of slot mask most widely used in conventional color cathode ray tubes.
Figure 1B:
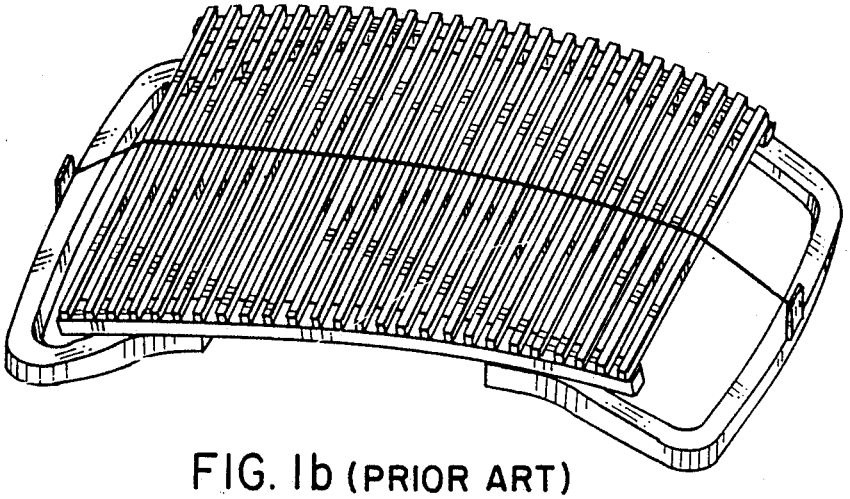
FIG. 1b (PRIOR ART)
FIG. 1*b* is a schematic view of a slit mask of another type also in use.

Application of a tension T=40 lb./in. to the end members produces a force Tc=1.2 lb. per strip. Under the influence of this tensioning force, each 16-inch long strip becomes 0.167%, or 0.027" longer; at the same time, as a consequence of Poisson contraction, its 0.024" width shrinks by 0.048%, or 11.6 microinches. While this may seem a negligible amount (it represents less than 1/500 of the slit width), there are 733 strips within the 22" width of the picture area; the cumulative effect of the simultaneous narrowing of all these strips is to reduce the width W of the mask by $733 \times 0.000\,0116 = 0.0085$ inch, thus producing an unacceptable misalignment of 0.0043 inch on each side. Narrowing of this order is actually observed when a foil mask of the conventional configuration illustrated in FIG. 1*a*, with tie pitch of the same order as strip spacing (p=c) is stretched over two rails as indicated in FIG. 2*b*. Because no narrowing can occur directly adjacent to the two end members 4, the mask upon stretching distorts into an hourglass-like shape.

An analogous problem arises when the stretched mask is heated by the electron beams in the finished tube. Temperature expansion in length as well as width is then linearly superposed upon the elastic deformations just described. Suspended under high mechanical tension between the two supports 5, strips 2 do not actually become longer when heated; instead, their tension decreases. With a temperature coefficient of 13 parts per million/degree C. and the original elastic strain of 0.167% as mentioned above, every degree of temperature rise reduces the tension by 13/1670, or 1 part in 128. At the same time, a corresponding fraction of the Poisson contraction disappears, allowing the strips to become a little wider. This effect is added to the normal temperature expansion of the mask width. Calculation shows that for the example given, the effective temperature coefficient of mask width expansion, counting strips as well as ties, is 16 parts per million/degree C., or 352 microinches per degree C. for the 22" of mask width. At this rate, a 24 degree C. temperature rise is just enough to cancel the 0.0085" Poisson contraction previously mentioned. At the same time, the tension decreases from 40 lb./in. to 32.5 lb./inch. Any further heating would cause the mask to bulge on both sides. This, of course, would also be unacceptable.

The solution to this impasse lies in shifting the equilibrium between the two counteracting tendencies, i.e., Poisson contraction and temperature expansion on one hand, and the straightening of the strips under tension on the other hand, in favor of the latter. According to this invention, that object is achieved by taking advantage of the fact that the forces behind Poisson contraction and temperature expansion decrease inversely with the fourth power of the tie pitch p, so that increasing p by a factor of 30, for example, causes a nearly millionfold reduction of that undesired force, while the straightening effect is essentially independent of tie pitch. This remarkable fourth power discovery is explained in greater detail in the following.

Figure 3A:
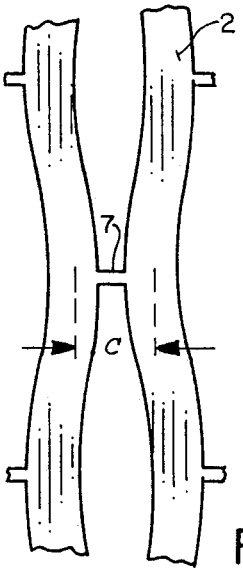
FIG. 3*a* is an enlarged view of a small section of a slit mask showing a condition of elastic distortion greatly exaggerated for illustrative purposes.

FIG. 3*a* illustrates schematically a pair of adjacent strips 2 interconnected by tie 7. The spacing p between ties in one slit is large compared to the normal center-to-center spacing c of the strips. The strips are shown in a state of elastic distortion; it is assumed than an external force is pulling them apart in a transverse direction. The strips respond by bending as shown within the plane defined by tie spacing p and strip width w. The resulting deformation of the strips is shown exaggerated by a factor of 1000 for the purpose of clarity; the actual ratio of u/w (FIG. 3*b*) is about 1/2000. It should be kept in mind that the strips are actually much longer than the portion shown; the applied transverse force is assumed to be uniformly distributed about the full length of the strips. For the purpose of this computation, the presence of the end members and any end effects produced by the end members are disregarded.

Figure 3B:
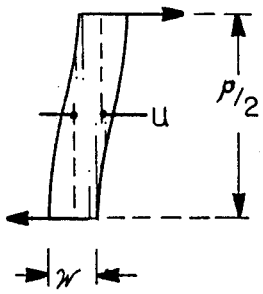
FIG. 3*b* is a detail view of a portion of the section shown by FIG. 3*a;*

The externally applied transverse force is transmitted from strip to strip by the ties. Each tie distributes its force evenly between two portions of the strip, one above and one below the tie. Because of this symmetry, the angle between each tie and the adjacent portion of the strip remains 90 degrees as indicated, even under stress. Each portion of each strip of length p/2 located between two ties attached to opposite sides of the strip forms a double (end-to-end) cantilever as shown in FIG. 3*b*. The stiffness, i.e., the ratio between applied force and resulting deflection, for such a cantilever is known to be $8tw^3E/p^3$, where t is the thickness of the foil and E the elastic modulus. Note that t and w appear to be interchanged compared to the usual equation, because of the unusual way in which the strips bend in this case.

The stiffness so computed applies to a length of p/2; for the full picture height H, the above expression must be multiplied by H/(p/2), resulting in the expression for the coupling stiffness $C_1$ $$C_1 = \frac{16tw^3EH}{p^4}$$

The physical meaning of $C_1$ is the following: when a transverse force F is applied to a mask of height H, with the end members removed, each strip will be so deformed that the deflection u (FIG. 3*b*) equals $u=F/C_1$. The deflections of adjacent strips are symmetrical; the increase in their mutual spacing varies from 2u at the points of maximum deflection to 0 where they are connected by a tie. The average increase in their spacing is therefore also equal to u.

The practical consequences of the inverse fourth power dependence will now be illustrated. Suppose, again, that the center-to-center spacing c between the strips is 0.030", with a strip width w of 0.024". Foil thickness t=0.001", picture height H=16" and the elastic modulus $E=3\times10^7$ lb./in$^2$. The resulting coupling stiffness will be 27,100 lb./in. for p=0.25", 1,700 lb./in. for p=0.5", 106 lb./in. for p=0.1", and 56 lb./in. for p=1.175".

Figure 3C:
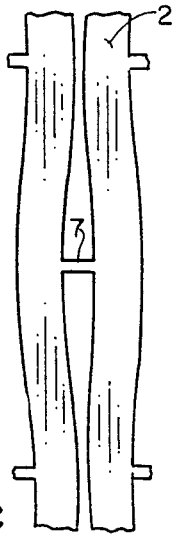
FIG. 3*c* is an enlarged view of a small section of the mask, and showing a condition of distortion due to heating.

FIG. 3*a* represents the type of distortion produced when the narrowing of the mask caused by the Poisson contraction of the individual strips is opposed by the application of an external transverse force pulling the strips apart. FIG. 3*c*, also exaggerated, illustrates the situation produced when the mask is heated to the point where it tends to bulge. Here, the external force pushes the strips together, and the direction of the resulting elastic distortion is reversed. The above equation for the coupling stiffness $C_1$ still applies.

This analysis might be objected to on the basis that a network of thin metal strips of the kind described, when subjected to transverse forces as shown, would not distort as illustrated; instead, the strips would buckle and twist out of their original plane. It is well known, however, that buckling occurs only when the applied force exceeds a certain threshold; in the present mask, this threshold is greatly increased by the applied tension which forces the strips to remain flat. The microscopic deformations actually encountered in the mask remain far below that threshold.

Figure 4:
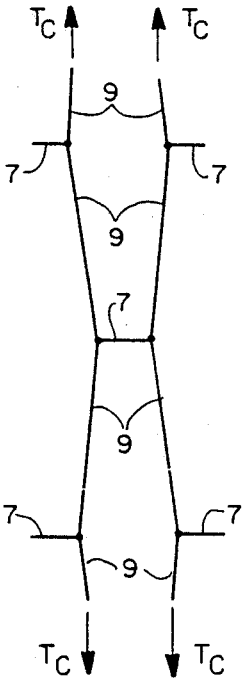
FIG. 4 is an analog that illustrates schematically the distortive effect of the coupling stiffness of thin metal strips.

The forces arising from elastic deformation are not the only contributors to coupling stiffness. Even if the metal strips 2 were to be replaced by perfectly flexible chains which can be deformed without applying any significant force, the fact that these chains are under tension would cause a coupling stiffness to arise between adjacent chains. FIG. 4 illustrates how tensed chains 9, assumed to be perfectly flexible, would respond to transverse forces applied to ties 7. The tensioning force per unit width is T, so that the force per chain is Tc.

From the parallelogram of forces rule applied to FIG. 4, it can be shown that for small angles the stiffness per tie equals 4 Tc/p; thus for the picture height H, the additional contribution to the coupling stiffness, designated $C_2$, is:

$$C_2 = \frac{4\,TcH}{p^2}$$

For the previously computed example, with T=40 lb./in., the additional coupling stiffness is 1,229 lb./in. for p=0.25", 307 lb./in. for p=0.5" and 77 lb./in. for p=1". At a tie spacing of 1.175", the additional coupling stiffness $C_2$ drops to 56 lb./in., the same value as the coupling stiffness $C_1$ computed on the basis of elastic deformation only. If the tie pitch p is further increased, the total coupling stiffness C, i.e., the sum $C_1+C_2$, continues to drop with the inverse square of p. For values of p above about 1", $C_1$ rapidly becomes negligible. This behavior is illustrated in the plot of FIG. 5.

Figure 5:
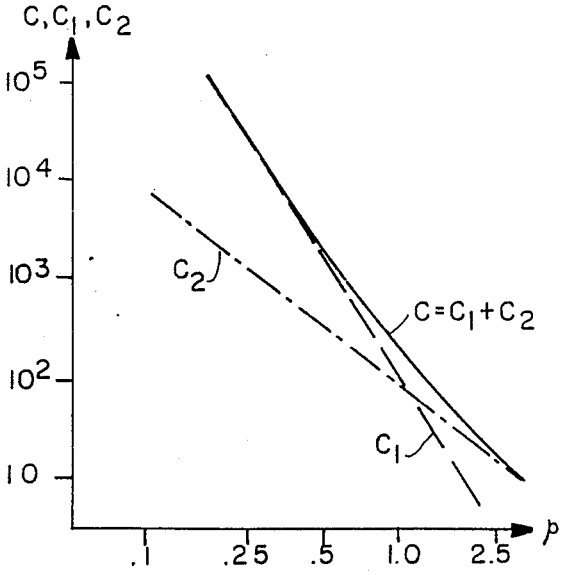
FIG. 5 is a family of curves indicating the effect of coupling stiffness resulting from elastic deformation.

The dashed line in FIG. 5 shows the inverse fourth power behavior of the coupling stiffness $C_1$ resulting from elastic deformation; the dash-dot line denotes the inverse square law behavior of the additional coupling stiffness $C_2$ produced by the tension on the strips, and the solid line $C_1+C_2$ indicates the total coupling stiffness C. Note that the scales are logarithmic, the coupling stiffness scale extending over five orders of magnitude while the scale for tie spacing p extends over a little more than one order.

The above computation contains certain approximations. For example, it applies only to small deformations. It also presupposes that the tie spacing p is large compared to the strip width w. However, these limitations are perfectly compatible with the mask structure contemplated by this invention and with the conditions accompanying its use.

Figure 6:
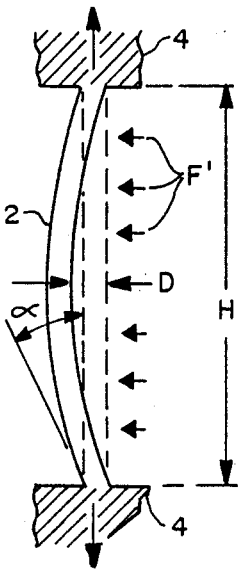
FIG. 6 is a diagram indicating the effect of deflection on strip contour.
Figure 7A:
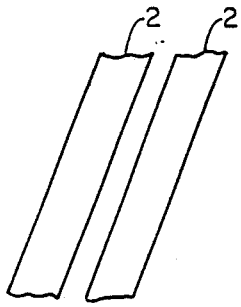
FIGS. 7*a* and 7*b* indicate, respectively, the effect of the lack of a tie, and the presence of a tie, on strip contour when adjacent strips are deflected.
Figure 7B:
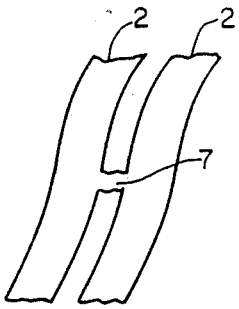
Figure 8A:
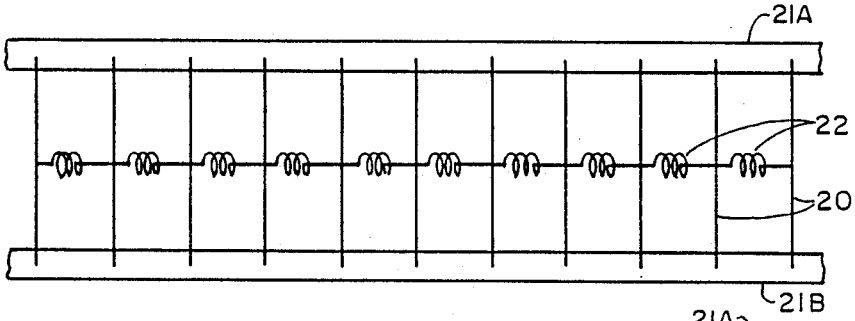
FIGS. 8*a* and 8*b* are analogs that respectively indicate schematically the effect of coupling stiffness versus strip stiffness using leaf springs as examples.
Figure 8B:
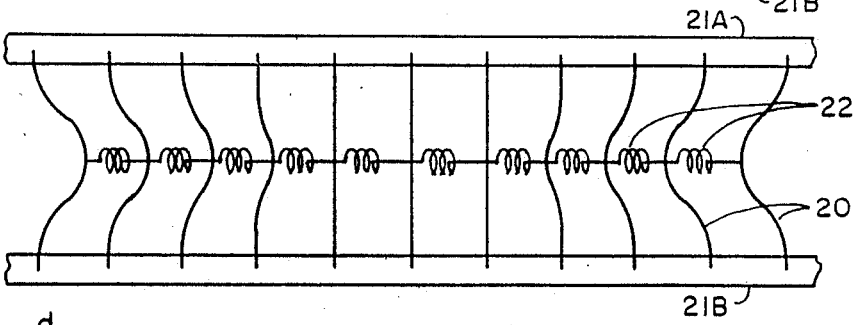
Figure 8C:
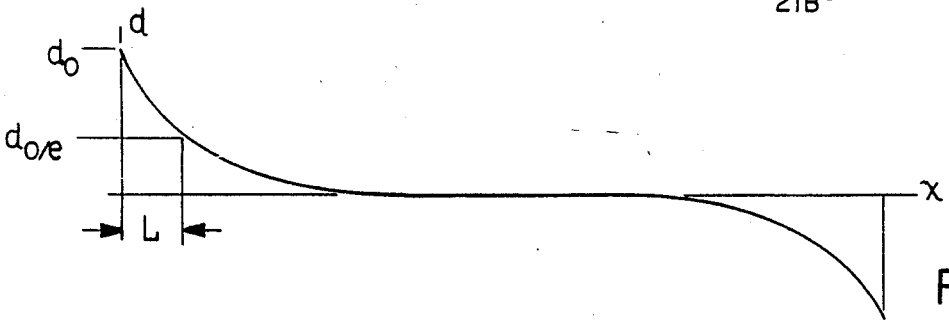
FIG. 8*c* is a plot of leaf spring deflection versus distance "x"

The coupling stiffness C directly determines the amount of transverse force which is exerted upon the strips by the ties as a consequence of Poisson contraction and temperature expansion. As previously explained, this transverse force is opposed by the tendency of the tensioned strips to remain straight. When a strip 2 tensioned between end members 4 is deflected from its rest position by a transverse force F' uniformly distributed over its entire length (FIG. 6), it will deflect so as to form an arc which, for small deflections, may be considered a parabola with its apex at the midpoint of the strip. The ratio between the total force F', summed over the entire strip length which is also the picture height H, and the deflection at the midpoint may be defined as the strip stiffness S.

With a tension T per unit width, the tension force per strip equals Tc. From the parallelogram of forces follows that the angle $\alpha$, in the small angle approximation, must equal $\alpha=F'/2Tc$. From the geometry of a parabola, $D=\sqrt{H/4}$, therefore the strip stiffness $S_1$, resulting from tension, is $$S_1 = \frac{F}{D} = \frac{8Tc}{H}$$

This simple expression gives the stiffness of a tensioned flexible string. It does not take into account the elastic stiffness of the actual strip. For the dimensions of a practical mask—in the previous example, strip length H was 16" while strip width w was 0.024"—this omission is permissible, except that the effective length is reduced somewhat by the fact that the ends are constrained and unable to rotate by the angle $\alpha$. This correction would stiffen the strips somewhat. Without the correction, for T=40 lb./in. and c=0.03", we would have $S_1$=0.6 lb./in.

A more important addition to the stiffness is produced by the ties. This is best illustrated by the schematic drawings, FIGS. *7a* and *7b*. FIG. *7a* shows a small region within the upper half of two adjacent strips 2, assumed to be deflected toward the left by an applied force, in the absence of ties. FIG. *7b* shows the same portion in the presence of a tie 7. The strips as well as the tie must be elastically deformed in order to permit the two strips to tilt. The result is additional strip stiffness. Only approximate computations of this additional stiffness have been made. They indicate that, for tie spacings between 0.5" and 1.5" in the example used above, effective strip stiffness will be between 2 and 3 times $S_1$. Considering that high strip stiffness is desirable, a factor of 2 represents a conservative estimate. The actual strip stiffness S in the above example is therefore estimated at 1.2 lb./in.

To understand how coupling stiffness C and strip stiffness S interact in the mask, it is best to consider the model of FIG. *8a*. Here many equally constructed elastic leaf springs 20 are firmly rooted in a heavy baseplates 21A and 21B. Each leaf spring is coupled to its neighbors by coil springs 22; all coil springs are alike. Clearly, this assembly can serve as a model for the mask, with the leaf springs representing the strips with their stiffness S while the coil springs represent the coupling between strips, characterized by the coupling stiffness C.

The simplest condition for this system is realized if the coil springs are inserted across the leaf springs under zero tension. All leaf springs then remain straight and all coil springs remain relaxed.

But let it be assumed that each coil spring is shortened by a small amount before it is inserted, the increment representing a fraction s of its original length. Now when all coil springs are in place, the entire assembly is under tension; the leaf springs are deflected toward the center of the assembly as illustrated in FIG. *8b*. This condition represents the state of the mask previously described, where Poisson contraction produces a transverse force tending to pull the strips closer together. It will be noted in FIG. *8b* that the outermost leaf springs on the extreme left and right show the largest deflection; going from there toward the center, the deflection decreases in geometric progression, and no deflection is visible throughout the inner portion of the assembly. The deflected leaf springs on the ends jointly produce the force required to keep the coil springs throughout the inner portion under the same tension under which they were inserted.

FIG. *8c* shows a plot of leaf spring deflection d vs. distance x. It is found that the deflection d drops on the left side drop exponentially with x, decreasing e times for every distance increment L: $d=d_o e^{-x/L}$. Deflection d on the right side is a mirror image of that on the left side.

The outermost leaf spring is deflected by $d_o$. Using the previously defined terms: c for center-to-center leaf spring spacing (leaf springs representing strips in the mask), s the fractional stretching of the coil springs (corresponding to the fractional Poisson contraction or transverse thermal expansion of the mask in the absence of any countervailing force), C the coupling stiffness, i.e., the spring rate of the coil springs and S the leaf spring (or strip) stiffness, the following relations can be shown to hold:

$$L=c\sqrt{C/S};\ d_o=sL=sc\sqrt{C/S};$$

It should be noted that C/S is the number of leaf springs or strips over which the deflection decreases by a factor of e.

If $\sqrt{C/S}$ were a very large number, corresponding to a very slow decay of the deflection toward the opposite end, then the effects of both ends would have to be taken into account in the central portion, resulting in having to replace the exponential term by a hyperbolic sine. This, however, is a condition to be avoided, since all deflections increase with $\sqrt{C/S}$.

In the example used several times before, the conservatively estimated strip stiffness S was 1.2 lb./in. Total coupling stiffness C and the values of $\sqrt{C/S}$ and of L for four different tie spacings p are given in the table that follows:

| p inches | p/c | C lb./in. | S lb./in. | $\sqrt{C/S}$ | L inches | $d_o$ mils |
|---|---|---|---|---|---|---|
| 0.25 | 8 | 28,300 | 1.2 | 154 | 4.62 | 1.8 |
| 0.5 | 16 | 2,000 | 1.2 | 41 | 1.23 | 0.48 |
| 1.0 | 33 | 183 | 1.2 | 12.3 | 0.37 | 0.14 |
| 1.175 | 39 | 112 | 1.2 | 9.7 | 0.29 | 0.11 |

Under a tension of T=40 lb./in., the unopposed Poisson contraction, as previously calculated, is −0.0085" over a mask width W=22", a fractional change of s=−0.00039. Multiplying this with the values of L in the above table, the deflection of the outermost strip would be $d_o$=1.8, 0.48, 0.14 and 0.11 mils, respectively. While the last three of these figures appear acceptable, consider thermal expansion upon heating; as previously mentioned, a temperature rise of 24 degrees C would cancel the Poisson contraction while reducing tension by 19%. A temperature rise of about 96 degrees C. would cause a transverse mask expansion of 0.025", corresponding to s=0.00115, while the reduced tension causes the strip stiffness S to drop to one-quarter of its room temperature value, resulting in a doubling of $\sqrt{C/S}$. For the four spacings, the table now reads as follows:

| p inches | p/c | C lb./in. | S lb./in. | $\sqrt{C/S}$ | L inches | $d_o$ mils |
|---|---|---|---|---|---|---|
| 0.25 | 8 | 28,300 | 0.3 | 307 | 9.21 | 10.6 |
| 0.5 | 16 | 2,000 | 0.3 | 82 | 2.46 | 2.83 |
| 1.0 | 33 | 183 | 0.3 | 24.7 | 0.74 | 0.85 |
| 1.175 | 39 | 112 | 0.3 | 19.3 | 0.58 | 0.67 |

The corresponding deflection of the outermost strip is now 10.6, 2.83, 0.85 and 0.67 mils, respectively. The first two spacings are unacceptable. The third one may be acceptable as an extreme operating condition; however, it is not necessary to accept it. A significant improvement can be obtained by extending the strips a short distance beyond the picture area. For example, 0.55" inside the region occupied by the strips (x=0.55"), the deflection d has dropped to 0.40 mils, since $$d=0.85\times e^{-0.55/0.74}=0.40 \text{ mils.}$$

Figure 9:
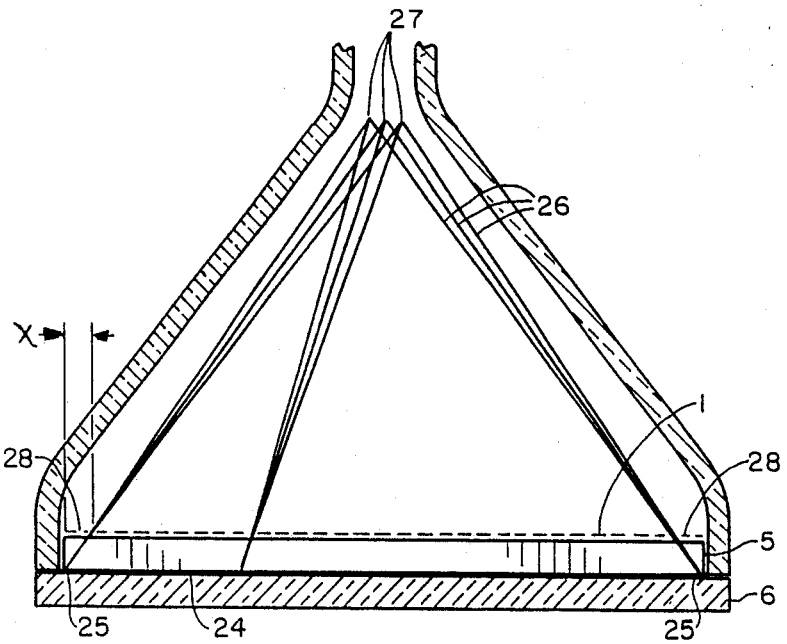
FIG. 9 is cross-sectional view in elevation of a cathode ray tube having a tied slit mask, and showing the relationship of electron beam excursion with the effective mask area.

A practical arrangement in which the strips are extended is illustrated in FIG. 9, which shows a section through an operating tube constructed according to the invention. The section is taken parallel to mask supports 5. On the inside of faceplate 6 there is deposited phosphor screen 24, extending between edges 25. Electron beams 26, after being deflected by the magnetic yoke (not shown), appear to come from the three centers of deflection 27. Beams which are deflected beyond edges 25 and therefore fail to reach screen 24 are not useful; therefore, marginal portions 28 which comprise an immediately adjacent inactive border section of the tied slit mask, and which are of the order of 0.5" wide in large entertainment type tubes, do not participate in forming the image as does the central active section of the mask, and may therefore be used as extensions to produce the improvement explained above. The effect of the apertured area in the inactive section is to reduce the position errors of the extreme strips in the active section induced by Poisson contraction and thermal expansion.

Returning now to the chart, the fourth and largest spacing is clearly acceptable, and it would seem that even larger spacings would be better still. But it should be kept in mind that before tension is applied to the mask, the coupling stiffness term $C_2$ above discussed is absent, and the overall transverse stiffness of the mask, controlled by $C_1$ alone, continues to decrease inversely with the fourth power of the tie spacing. Such rapid further decrease is undesirable from the standpoint of easy handling of the mask in production. Therefore, the optimum tie spacing is the smallest spacing which ensures that the strips at the edges of the viewing area do not deflect by more than a permissible amount under normal operating conditions.

It has been shown that there exists a range of tie spacings, centered on a pitch of the order of one inch for large entertainment type tubes, corresponding to a ratio of p/c of at least 16, which enables slit masks to be mounted under tension across two support structures with the assurance that strip spacings will not depart significantly from the spacings in the region where the strips join the end members. The spacing of the ties according to the invention is preferably many times greater than the pitch of the strips, e.g. more than 16 times greater A machine for performing the mounting operation will now be described. The specific purpose of the machine is to receive a faceplate carrying two support structures and a completed screen, comprising grille, phosphor stripes and aluminum film, and also to receive a tied slit mask structured in accordance with the invention, faceplate as well as mask having been manufactured as interchangeable components; to position these two components relative to each other in a predetermined manner; to apply a predetermined tensioning force to the mask in a direction parallel to the slits; and to weld the end members of the mask to the respective support structures.

Figure 10A:
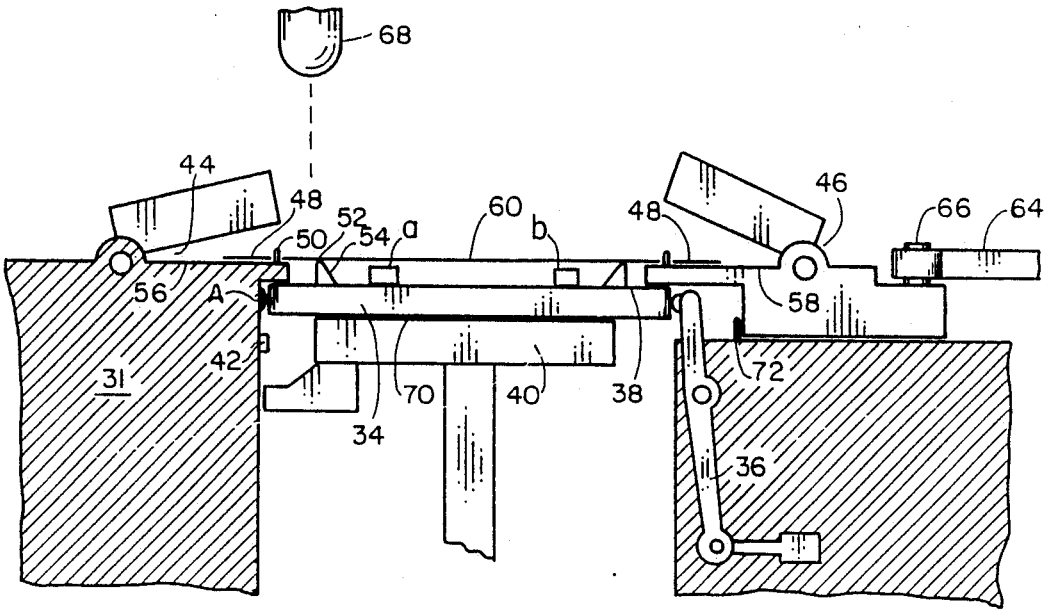
FIG. 10*a* is a diagrammatic side view in elevation of a machine for mounting a tied slit mask.
Figure 10B:
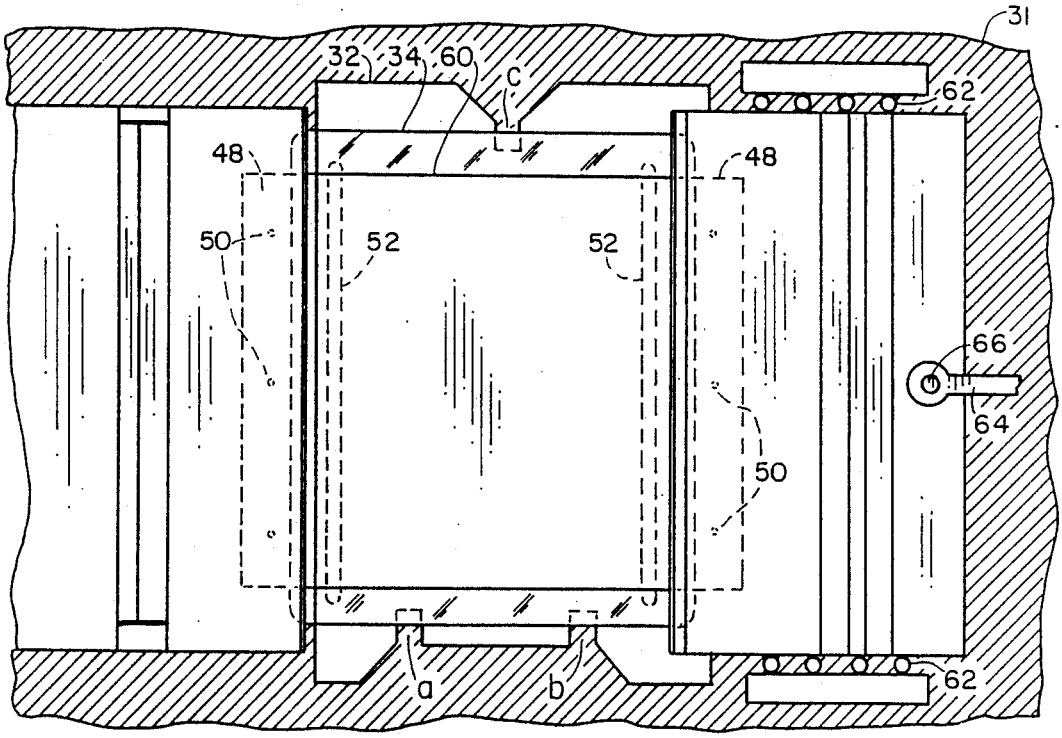
FIG. 10*b* is a plan view looking down at the machine.

FIGS. 10*a* and 10*b* show a side view and a top view, respectively, of the essential components of such a machine. A rigid frame 31 defines a rectangular window-like opening 32 large enough to admit a faceplate 34. Attached to the vertical walls of the frame are three half-balls A, B and C (only half-ball A is shown) for reproducibly locating the faceplate in a plane parallel to its major surfaces. A pneumatically driven lever 36 may be energized to apply a force to a corner of the faceplate generally opposite the three half-balls in order to press the faceplate against the half-balls. The frame also carries three vertical stops a, b and c which together define the location of the flat inside surface 38 of the faceplate (FIG. 10*a*); a vertically movable table 40 which carries the faceplate may be pneumatically lifted to bring the faceplate into contact with the three vertical stops. The same table, when not carrying a faceplate, may be lifted further to a position defined by stop 42 connected to the frame, for the purpose of supporting the mask during insertion.

Opening 32 is flanked on two sides by large clamps 44 and 46, capable of clamping the two end members 48 of the mask and holding them firmly. Each clamp 44, 46 may be made up of two single wide jaws; alternatively, one or both jaws may be subdivided for more uniform distribution of clamping pressure. If this is done, care must be taken to avoid any lateral motion of different portions with respect to each other. Tapered, retractable registration pins 50, corresponding to photoetched holes in the mask, serve to locate the mask in the two clamps. There must be at least one pin in each clamp; to ensure better flatness of the end members before the clamps close, it is preferred to use several pins, three being shown in each clamp in FIG. 10*b*.

When faceplate 34 has been lifted by table 40 so that its inner surface 38 makes contact with the vertical stops a, b and c, the top surfaces 52 of support structures 54 affixed to the faceplate are just a few thousandths of an inch higher than the top surfaces 56 and 58 of clamps 44 and 46. (Preferred configurations of a support structure 54 are the subject of referent U.S. Pat. Nos. 4,686,416 and 4,695,761 of common ownership herewith.) Clamp 44 is firmly mounted on frame 31; clamp 46 is seated against stop 72 until such time as it is moved outward so as to apply tension to mask 60. During such motion, clamp 46 is guided by linear ball bearings 62 so that it moves in a straight line and its lateral position is precisely maintained. Pull rod 64, attached to clamp 46 by pin 66, is linked to a pneumatic driver (not shown) designed to apply the required force of, for example, 920 lb. (40 lb./in. across 23", i.e., W=22" plus 0.5" of extra strips on each side) to stretch the mask. A laser welding head 68 can be moved into position above the faceplate to weld the mask to the two support structures. When not in use, the laser welding head is moved out of the way to permit inserting a mask.

Operation of the machine is as follows: first, the empty table 40 is raised to its highest position defined by stop 42. In this position, its top surface 70 is at the same height as the surfaces 56 and 58 of clamps 44 and 46. A mask is then slipped over the registration pins 50, clamp 46 having been moved into the proper position against stop 72, to accept an untensed mask. Mask insertion is facilitated by the nearly continuous plane formed by surfaces 56, 70 and 58.

Next, the two clamps are closed, preferably by pneumatic or hydraulic means, and the pneumatic driver is actuated. As the force on pull rod 64 builds up, clamp 46 moves outward, applying unidirectional tension to the mask; with a picture height of H=16", the displacement of clamp 46 may be about 0.025 to 0.030".

Table 40 is now lowered to allow a faceplate to be placed thereon. The table is then lifted until the faceplate nearly touches the vertical stops. At this point, lever 36 is energized to slide the faceplate into contact with half-balls A, B and C. As soon as the faceplate is seated against the half-balls, the table is lifted further to press the faceplate against the vertical stops a, b and c. At the same time, top surfaces 52 of the support structures touch the tensed mask and gently lift it by a few thousandths of an inch, thus assuring good contact. The assembly is now ready for welding. Laser welding head 68 is placed into position and moved under computer control along a path which enables it to weld the two end members to the two support structures. This completes the assembly process. Pneumatic pressure is released and portions of the end members extending beyond the support structure are cut off by mechanical means or by the laser. Lever 36 is released and table 40 is lowered to a position in which the finished assembly can be removed; the clamps are opened and the registration pins momentarily retracted so that the cut off end member portions can be discarded. Finally, clamp 46 is returned to its starting position in readiness for the next cycle.

The use of a laser for welding and trimming a foil mask is described and claimed in referent copending application Ser. No. 058,095 of common ownership herewith.

It is desirable to provide a slit mask with ties which, at minimum normal viewing distance, are not visible to the viewer. In a conventional slot mask of the type illustrated in FIG. 1*a*, the spacing between tie bars within any given slot is of the same order as the center-to-center spacing between the strips. From a normal viewing distance, the tie bars appear so closely spaced that individual tie bars cannot be distinguished.

In a tied slit mask according to the invention on other hand, the ties within any given slit are widely spaced, e.g., about one inch. In adjacent slits, they are staggered as shown in FIG. 2*c*. Therefore, at every half inch of vertical height there is a tie in every other slit. It has been found that if all ties are arranged exactly at their nominal height, i.e., along straight horizontal rows spaced about one-half inch apart, the resulting pattern of straight horizontal lines may be visible in spite of the very small size of the ties.

Figure 11:
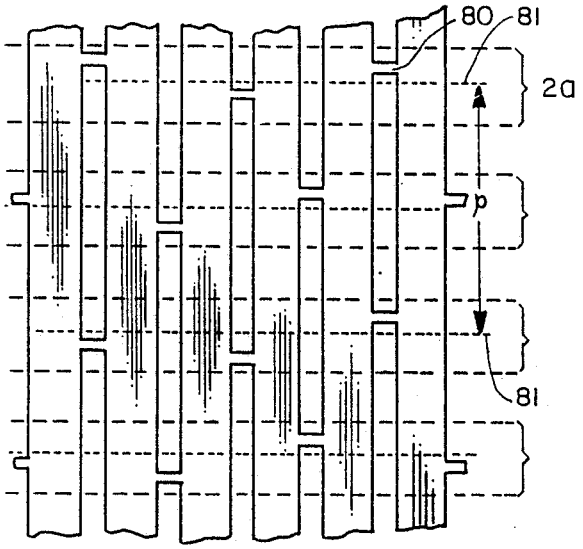
FIG. 11 is a plan view of a section of an embodiment of the aperture configuration of a tied slit mask.

The arrangement shown in FIG. 11 avoids such visibility. In this arrangement, the vertical position, or pitch, of the ties 80 is not constant but is randomly varied from tie to tie to suppress tie visibility. However, each tie is placed within an area of width 2*a* centered about its nominal position (see the dotted lines 81). The width of 2*a* may be 10% to 30% of p; for example, 0.02". The random variation breaks up the straight lines previously mentioned and renders the ties practically invisible at normal viewing distances.

Figure 12:
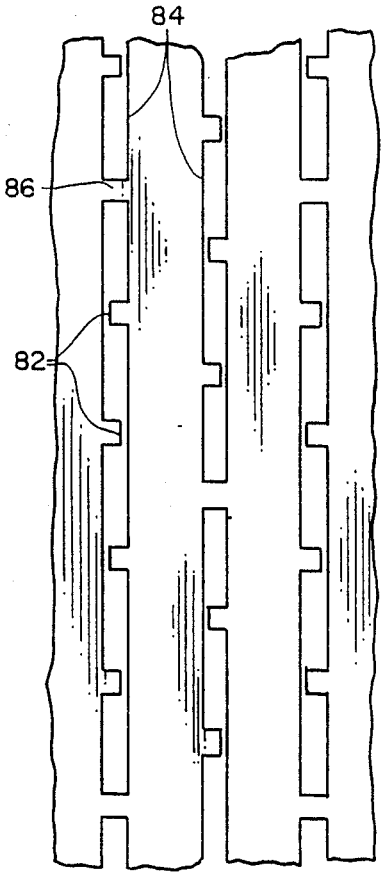
FIG. 12 is a view similar to FIG. 11 depicting an aperture configuration having false ties according to the invention.

A shadow mask according to the invention may have between the strips one or more false ties extending partially between but not interconnecting adjacent strips. FIG. 12 depicts such a mask configuration adapted to reduce tie visibility. False ties 82 are indicated as being placed along the slit edges 84 at regular intervals between the real ties 86 and with a pitch less than that of the real ties. They resemble real ties but do not interconnect the strips. The number of false ties may be chosen strictly on the basis of appearance (or lack thereof) under normal viewing conditions. For example, and according to the invention, each tie may be separated by an even number of false ties, the ties and false ties being arranged in a staggered fashion across the mask. Inserting an even number of false ties between pairs of real ties is preferred because it permits the staggered arrangement of real and false ties as shown.

Figure 13:
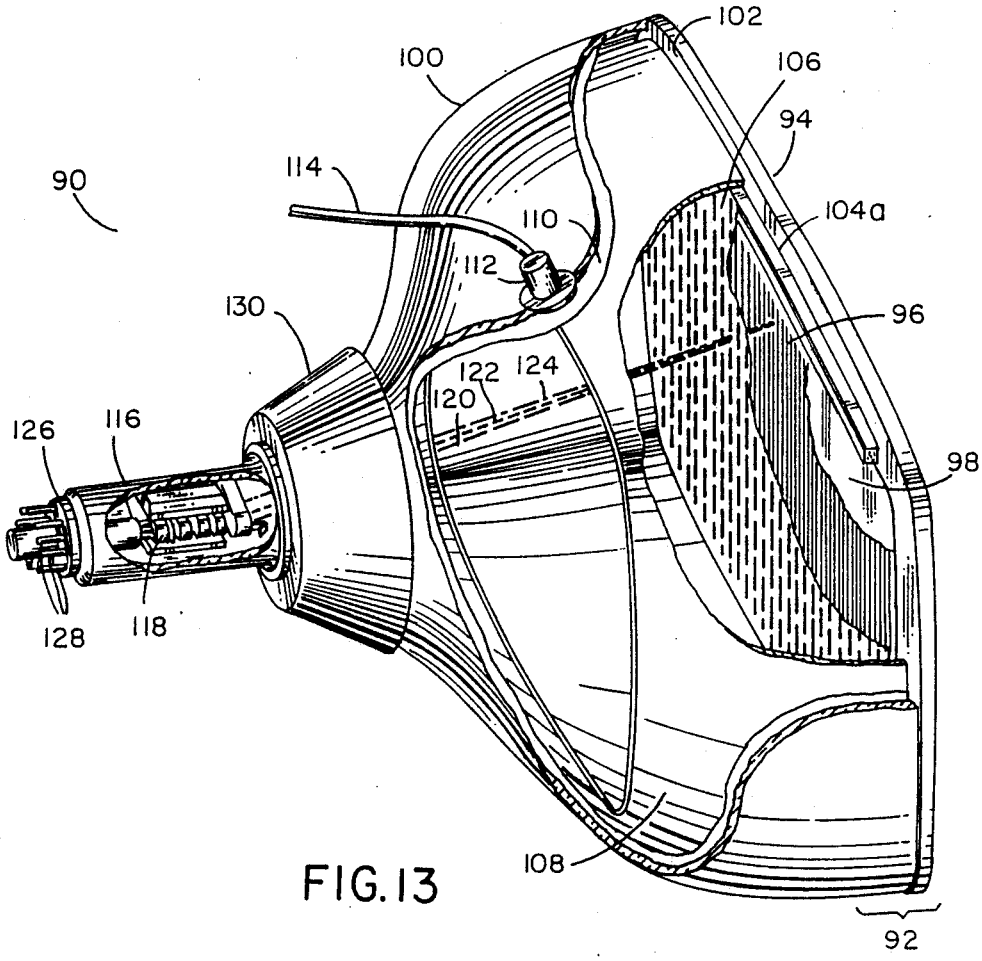
FIG. 13 is a side view in perspective of a color cathode ray tube in which is mounted a slit-type shadow mask having false ties according to the invention; cutaway sections indicate the location and relation of the mask to other major tube components.
Figure 14:
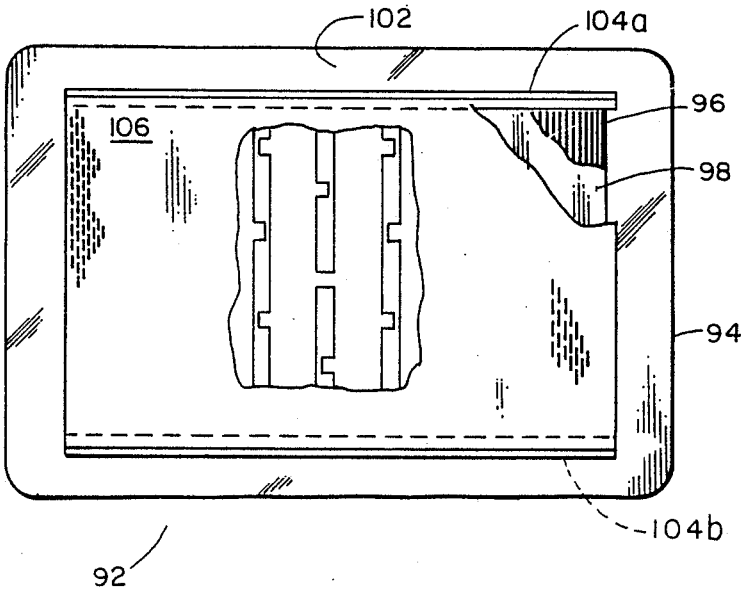
FIG. 14 is a plan view of the front assembly of the tube shown by FIG. 13, taken from the aspect of the electron gun, and with parts cut away to show the relationship of the tied slit mask having false ties according to the invention with the faceplate and screen; an inset based on FIG. 12 depicts the slits of the mask and the false ties greatly enlarged.

A front assembly in which the mask and/or the screen has false ties according to the invention includes a glass faceplate having on its inner surface a centrally disposed phosphor screen, and a slit-type foil shadow mask as described heretofore and pictured in FIGS. 2*c* and 12, and supported by mask support means. Such a front assembly is depicted as mounted in a cathode ray tube in FIG. 13; FIG. 14 depicts the front assembly of the tube from the viewpoint of the electron gun. The tube and its component parts are described in the following paragraphs in this sequence: reference number, a reference name, and a brief description of structure, interconnections, relationship, functions, operation, and/or result, as appropriate.

90 color cathode ray tube

92 front assembly according to the invention

94 glass faceplate

96 centrally disposed phosphor screen consisting of a pattern

Of spaced vertical lines comprising a sequence of red-light-emitting, green-light-emitting and blue-light-emitting phosphors, the lines relating to the pattern of the slits of the shadow mask.

106 according to the invention (described below); the lines are interspersed by a grille, or "black surround".

98 film of aluminum deposited over screen

100 funnel

102 peripheral sealing area of faceplate 106, adapted to mate with the peripheral sealing area of funnel 100

104*a*, 104*b* support structures for the tied slit shadow mask according to the invention; the two structures are located on opposite sides of the screen 96 for receiving and securing a shadow mask.

106 foil shadow mask according to the invention; the mask is mounted in tension on the support structures 104*a* and 104*b* and the end members 4 are secured thereto as indicated by FIGS. 2*a* and FIGS. 10*a* and 10*b*; the apertures of the mask 106 are depicted in the inset 107 as being tied slits with false ties according to the invention based on the aperture configuration depicted in FIG. 12

108 internal magnetic shield

110 internal conductive coating on funnel

112 anode button

114 high-voltage conductor

116 neck of tube

118 in-line electron gun providing three discrete in-line electron beams 120, 122 and 124 for exciting the lines of red-light-emitting, green-light-emitting, and blue-light-emitting phosphors on screen 96

126 base of tube

128 metal pins for conducting operating voltages and video signals through base 218 to electron gun 208

130 yoke which provides for the transverse of beams 120, 122 and 124 across screen 96

A process according to the invention for use in the manufacture of a color cathode ray tube cathode ray tube having false ties comprises the following. The tube has flat faceplate and a foil shadow mask supported by a mask support structure attached to the faceplate for receiving and securing the mask. A shadow mask is formed to comprise a series of parallel strips separated by slits terminating in unslit end members transverse to the slits, the strips being loosely coupled by widely spaced ties. The tie spacing is such as to produce a strip coupling which promotes handleability of the mask during mask and tube fabrication and facilitates damping of strip vibration when mounted in a tube, but insufficient to induce unacceptable Poisson contraction of the mask when uniaxially tensed along the direction of the strips in the plane of the mask, or to produce an unacceptable thermal expansion perpendicular to and in the plane of the strips. The mask includes between the ties one or more false ties extending partially between but not interconnecting adjacent strips. A pattern of cathodoluminescent phosphors is deposited on the screen, the geometry of which is related to the pattern of the slits. Shadow mask support means is provided on opposed sides of the screen for receiving and securing the end members of the mask. The mask is then tensed and the end members are secured to the support means with the strips in alignment with the pattern of phosphoric deposits while the mask is under tension.

According to another aspect of the invention, false ties may also be incorporated into the screen. The front assembly described heretofore is noted as including a glass faceplate having on its inner surface a centrally disposed screen comprising spaced vertical lines in a sequence of red-light-emitting, green-light-emitting, and blue-light-emitting phosphors interspersed with grille lines. A metal foil shadow mask is mounted in tension on a mask-support structure located on opposed sides of the screen comprises a series of parallel strips separated by slits, the strips being coupled by widely spaced ties. The grille has spaced ties interconnecting the grille lines with a periodicity much smaller than that of the mask ties and below an observer's resolution threshold at normal viewing distances effective to mask the visibility of mask ties shadows on the screen.

Figure 15:
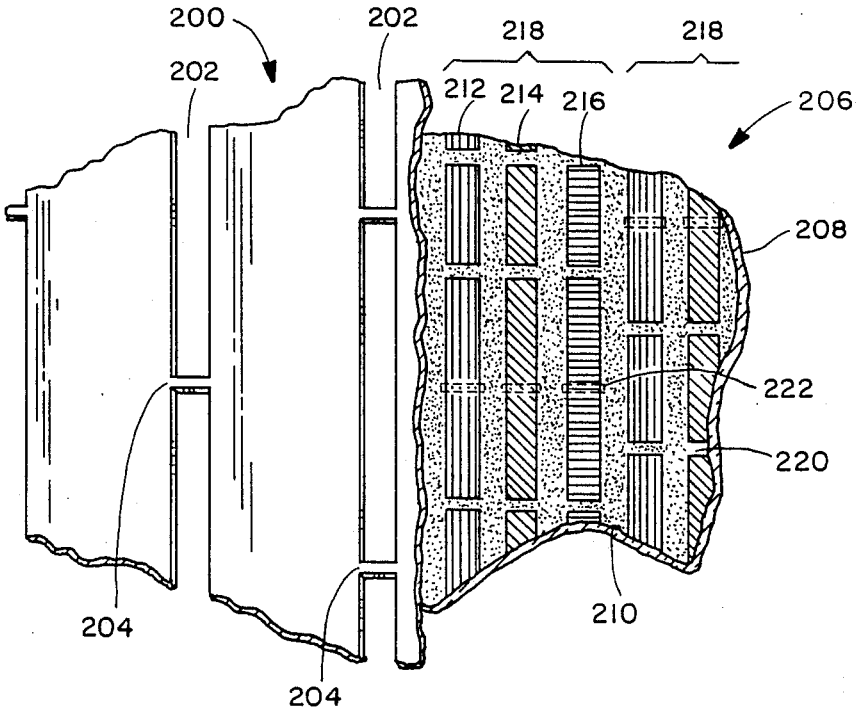
FIG. 15 is plan view of a tied-slit mask with an associated screen in which the screen is depicted as having spaced grille ties interconnecting the grille lines according to the invention.

FIG. 15 shows the arrangement schematically. Mask 200 has slits 202 which are bridged by ties 204. The openings between ties within a given slit is much larger than the spacing between adjacent slits; the correct ratio of these spacings could not conveniently be shown in the figure. Luminescent screen 206 is affixed to faceplate 208. It consists of a grille or black surround 210 and light-emitting phosphor strips 212 (red), 214 (green) and 216 (blue). The phosphor strips are arranged in trios 218, each trio corresponding to a specific slit 202 in the mask 200. The phosphor strips are periodically interrupted by narrow transverse regions 220; these regions are part of the grille, or black surround. They act as false ties and thereby, render the shadows 222 of the real ties 204 less conspicuous. For minimum visibility, the spacing between false ties 220 should be of the same order as the spacing between adjacent slits 202; thus, there should be many false ties on the screen for every real tie 204 in the mask. As mentioned, FIG. 15 is not drawn to scale and shows only two false ties per real tie.

Each false tie in the screen extends tranversely across a full trio. Between adjacent trios, false ties are staggered in the same manner as in the conventional mask shown in FIG. 1*a*. It is preferred not to have false ties in the locations of the electron shadow 222 of the real ties 204; a slight displacement of the mask along the direction of the slit, otherwise perfectly permissible, would displace the shadow with respect to such a false tie and thus create wider dark area. This undesirable effect is avoided by eliminating the false ties in the location indicated.

A process according to the invention for use in the manufacture of a front assembly for a color cathode ray tube having false ties on the screen comprises the following. The tube has a glass faceplate with a centrally located screening area and a metal foil shadow mask. A shadow mask is formed to comprise a series of parallel strips separated by slits terminating in unslit end members transverse to the slits, the strips being loosely coupled by widely spaced ties. A screen is formed by depositing a pattern of spaced vertical lines on the screening area comprising a sequence of red-light-emitting, green-light-emitting and blue-light-emitting phosphors. The geometry of the lines of phosphors is related to the pattern of the slits of the mask. The lines of phosphors are separated by grille lines. The grille lines are intersected with spaced grille ties having a periodicity much smaller than the ties of the mask and below an observer's resolution threshold at normal viewing distances. Shadow mask support means are provided on opposed sides of the screen for receiving and securing the end members of the mask. The mask is tensed and secured to the end members of the support structure while the mask is under tension and with the strips of the mask aligned with the lines of phosphors. As a result, and according to the invention, the visibility of the electron shadows of the mask ties in the screen during tube operation is suppressed.

The tied slit mask according to the invention can be formed by well-known photo-etching means, and the phosphor patterns comprising the screen can be applied by conventional screen printing or by offset printing. To form a screen having false ties according to the invention, decal means may be used.

Recapitulating the example used elsewhere in this specification, approximate dimensions of the front assembly having false ties according to a preferred form of the invention are summarized as follows:

Faceplate
Dimensions: 27" (diagonal measure)
Dimensions of screened area: 22"W by 16"H
Number of trios of phosphor lines: 733
Widths of phosphor lines: 0.0052
Shadow mask
Tension in lb/in.: about 40 per inch of width
Thickness: about 0.001"
Dimensions of usable area: 21"W by 16"H
Length of strips: 16"
Center-to-center strip spacing: 0.03"
Width of strips: 0.024"
Width of slits: 0.006"
Average pitch of ties: about 1.175"
Pitch of false ties in mask or on screen: 0.03"

While a particular embodiment of the invention has been shown and described, it will be readily apparent to those skilled in the art that changes and modifications may be made in the inventive means and process without departing from the invention in its broader aspects, and therefore, the aim of the appended claims is to cover all such changes and modifications as fall within the true spirit and scope of the invention.

What is claimed is:

1. A front assembly for a color cathode ray tube including a glass faceplate having on its inner surface a centrally disposed phosphor screen, and a metal foil shadow mask mounted in tension on a mask-support structure located on opposed sides of said screen, said mask comprising a series of parallel strips separated by slits, the strips being coupled by widely spaced ties, the mask having between the ties one or more false ties extending partially between but not interconnecting adjacent strips.

2. The front assembly defined by claim 1 wherein each tie is separated by an even number of false ties, the ties and false ties being arranged in a staggered fashion across the mask.

3. A front assembly for a color cathode ray tube including a glass faceplate having on its inner surface a centrally disposed phosphor screen, and a metal foil shadow mask mounted in tension on a mask-support structure located on opposed sides of said screen, said mask comprising a series of parallel strips separated by slits, the strips being loosely coupled by widely spaced ties, the tie coupling being such as to promote handleability of the mask during mask tube fabrication and to facilitate damping of strip vibration when mounted in a tube, but insufficient to induce unacceptable Poisson contraction of the mask when uniaxially tensed along the direction of the strips in the plane of the mask, or to produce an unacceptable thermal expansion perpendicular to said strips, and wherein the mask has between said ties one or more false ties extending partially between but not interconnecting adjacent strips.

4. A front assembly for a color cathode ray tube including a glass faceplate having on its inner surface a centrally disposed phosphor screen, and a metal foil shadow mask mounted in tension on a mask-support structure located on opposed sides of said screen, said mask comprising a series of parallel strips separated by slits, the strips being loosely coupled by widely spaced ties, the tie coupling being such as to promote handleability of the mask during mask and tube fabrication and to facilitate damping of strip vibration when mounted in a tube, but insufficient to induce unacceptable Poisson contraction of the mask when uniaxially tensed in the plane of the tube or to produce an unacceptable thermal expansion perpendicular to said strips, the spacing of said ties being many times greater than the pitch of the strips, e.g., more than 16 times greater, and wherein the mask has between the ties one or more false ties extending partially between but not interconnecting adjacent strips.

5. A front assembly for a color cathode ray tube including a glass faceplate having on its inner surface a centrally disposed phosphor screen, and a metal foil shadow mask mounted in tension on a mask-support structure located on opposed sides of said screen, said mask comprising a series of parallel strips of spacing "c" separated by slits, the strips being coupled by widely spaced ties having a pitch "p", the tie coupling being such as to promote handleability of the mask during mask and tube fabrication and to facilitate damping of strip vibration when mounted in a tube, but insufficient to induce unacceptable Poisson contraction of the mask when uniaxially tensed in the plane of the mask, or to produce an unacceptable thermal expansion perpendicular to said strips, the pitch "p" varying to suppress visibility of the ties, and wherein the mask has between the ties one or more false ties extending partially between but not interconnecting adjacent strips.

6. A front assembly for a color cathode ray tube including a glass faceplate having on its inner surface a centrally disposed screen comprising spaced vertical lines in a sequence of red-light-emitting, blue-light-emitting, and green-light-emitting phosphors interspersed with grille lines, and a metal foil shadow mask mounted in tension on a mask-support structure located on opposed sides of said screen, said mask comprising a series of parallel strips separated by slits, the strips being coupled by widely spaced ties, said grille having spaced ties interconnecting said grille lines with a periodicity much smaller than that of said mask ties and below an observer's resolution threshold at normal viewing distances effective to mask the visibility of mask tie shadows on the screen.

7. A foil tension mask for a color cathode ray tube comprising a series of parallel strips separated by slits, the strips being coupled by widely spaced ties, the mask having between the ties one or more false ties extending partially between but not interconnecting adjacent strips.

8. The tension mask defined by claim 7 wherein each tie is separated by an even number of said false ties, the ties and false ties being arranged in a staggered fashion across the mask.

9. A slit-type foil tension mask for a color cathode ray tube, comprising a series of parallel strips separated by slits, the strips being loosely coupled by widely spaced ties, the tie coupling being such as to promote handleability of the mask during mask and tube fabrication and to induce damping of strip vibration when mounted in a tube, but insufficient to induce unacceptable Poisson contraction of the mask when tensed, and wherein the mask has between the ties one or more false ties extending partially between but not interconnecting adjacent strips.

10. A slit-type foil tension mask for a color cathode ray tube comprising a series of parallel strips separated by slits, the strips being loosely coupled by widely spaced ties, the tie coupling being such as to promote handleability of the mask during mask and tube fabrication and to facilitate damping of strip vibration when mounted in a tube, but insufficient to induce unacceptable Poisson contraction of the mask when uniaxially tensed along the direction of the strips in the plane of the mask, or to produce an unacceptable thermal expansion perpendicular to said strips, and wherein the mask has between said ties one or more false ties extending partially between but not interconnecting adjacent ones of said stripes.

11. A slit-type foil tension mask for a color cathode ray tube comprising a series of parallel strips separated by slits, the strips being loosely coupled by widely spaced ties, the tie coupling being such as to promote handleability of the mask during mask and tube fabrication and to facilitate damping of strip vibration when mounted in a tube, but insufficient to induce unacceptable Poisson contraction of the mask when uniaxially tensed in the plane of the tube or to produce an unacceptable thermal expansion perpendicular to said strips, the spacing of said ties being many times greater than the pitch of the strips, e.g. more than 16 times greater, and wherein the mask has between said ties one or more false ties extending partially between but not interconnecting adjacent ones of said stripes, and wherein the mask has between said ties one or more false ties extending partially between but not interconnecting adjacent strips.

12. A slit-type foil tension mask for a color cathode ray tube, comprising a series of parallel strips of spacing "c" separated by slits, the strips being coupled by widely spaced ties having a pitch "p", the tie coupling being such as to promote handleability of the mask during mask and tube fabrication and to facilitate damping of strip vibration when mounted in a tube, but insufficient to induce unacceptable Poisson contraction of the mask when uniaxially tensed in the plane of the mask, or to produce an unacceptable thermal expansion perpendicular to said strips, and wherein the pitch "p" is not constant but varies to suppress visibility of the ties, and wherein the mask has between said ties one or more false ties extending partially between but not interconnecting adjacent strips.

* * * * *